US005519783A

United States Patent [19]

Kumar

[11] Patent Number: 5,519,783

[45] Date of Patent: May 21, 1996

[54] HEADPHONE ASSEMBLY

[75] Inventor: Rajendra Kumar, Akron, Ohio

[73] Assignee: Khyber Technologies Corporation, Fairlawn, Ohio

[21] Appl. No.: 319,454

[22] Filed: Oct. 6, 1994

Related U.S. Application Data

[63] Continuation-in-part of Ser. No. 88,685, Jul. 9, 1993, Pat. No. 5,357,585.

[51] Int. Cl.[6] ..... H04R 25/00

[52] U.S. Cl. ..... 381/183; 381/187; 181/129

[58] Field of Search ..... 381/68, 183, 187, 381/188, 25, 205; 181/128, 129; 379/430

[56] References Cited

U.S. PATENT DOCUMENTS

| | | | |
|---|---|---|---|
| D. 299,129 | 12/1988 | Wiegel | D14/37 |
| 3,792,754 | 2/1974 | Hanson | 181/31 B |
| 3,906,160 | 9/1975 | Nakamura et al. | 179/15 BT |
| 4,158,753 | 6/1979 | Gorike | 179/182 |
| 4,302,635 | 11/1981 | Jacobsen et al. | 179/156 |
| 4,654,898 | 4/1987 | Ishikawa | 2/209 |
| 4,965,836 | 10/1990 | Andre et al. | 381/183 |
| 5,117,465 | 5/1992 | MacDonald | 381/187 |
| 5,357,585 | 10/1994 | Kumar | 381/183 |
| 5,459,290 | 10/1995 | Yamagishi | 381/183 |

FOREIGN PATENT DOCUMENTS

| | | | |
|---|---|---|---|
| 3128598 | 5/1991 | Japan | 381/183 |
| 2188210 | 9/1987 | United Kingdom | 381/183 |

*Primary Examiner*—Curtis Kuntz
*Assistant Examiner*—Huyen D. Le
*Attorney, Agent, or Firm*—Sand & Sebolt

[57] ABSTRACT

A headphone assembly adapted for engaging a user's head includes an adjustable headband having first and second ends. A right ear piece is attached to a first end, and a left ear piece is attached to a second end of the headband. Each ear piece is substantially semi-circular shaped, and has a substantially inverted U-shaped shell having an inverted U-shaped inner wall. The U-shaped inner wall defines an acoustic cavity having a bottom end opening for receiving approximately the top half of the user's ear. A rear wall of the acoustic cavity has a number of holes extending therethrough behind which a speaker is mounted. An inverted U-shaped chamber is provided about the acoustic cavity. The right ear piece chamber will hold the electronic circuitry necessary for a cordless receiver. The left ear piece has a similar chamber which accepts a power board. A dome-shaped cover plate covers each of the speaker elements and the respective power board and circuit board, with the user's ear only partially enclosed by the ear piece. Alternatively, a planar cover plate covers each of the speaker elements and the respective circuit board, and a lower ear piece is pivotally attached to the upper ear piece for movement between an open position and a closed position. The lower ear piece also includes an acoustic cavity and has an open upper end for communicating with the bottom end opening of the U-shaped inner wall.

20 Claims, 6 Drawing Sheets

HEADPHONE ASSEMBLY

CROSS REFERENCE TO RELATED APPLICATION

This application is a continuation-in-part of application Ser. No. 08/088,685, filed Jul. 9, 1993 now U.S. Pat. No. 5,357,585.

BACKGROUND OF THE INVENTION

1. Technical Field

The invention relates generally to an improved headphone. More particularly, the invention relates to a headphone having improved ear pieces. Specifically, the invention relates to a headphone wherein the ear pieces provide space for the components of a cordless headphone, and which ear pieces are stable on the user's head, and provide ventilation to the users ears and the ability to hear ambient sounds.

2. Background Information

Portable radios and cassette players with small speakers that are held adjacent the ears of the user by a headband have become very popular in recent years. This popularity is increasing as cordless headphones, or self contained headphones, become available. While the use of such devices was originally limited to entertainment, the popularity of these devices has spurred their introduction into the industrial and manufacturing environments. Specifically, cordless headphones are often utilized in warehouse applications where a worker receives information from other workers, or from a scanning tool so that the worker can appropriately act on that information. Further, as headphones become increasingly lightweight and durable, their use during sporting activities is also increasing. While the popularity of these devices is increasing in every facet of society, a number of problems are still associated with the prior art designs.

A first type of prior art headphone includes ear pieces which rest against the user's head circum ambient to the user's ears, and completely encloses the user's ears as shown in FIG. 7. While such ear pieces is presumable sufficient for the purpose for which they were intended, they do not allow ventilation to the user's ears, and therefore, if the user is perspiring, the headphone will become increasingly uncomfortable. A further problem associated with this design is that inasmuch as the ear piece completely encloses the ear, the user is unable to hear ambient sound which is a potentially dangerous situation, especially if the user is in an industrial or manufacturing environment, or if the user is in a potentially dangerous situation recreationally, for example, when jogging or biking on a busy street. Lastly, this type of headphone cannot be worn comfortably by persons wearing earrings.

A second type of headphone as shown in FIG. 8, is also presumably sufficient to achieve the purpose for which it was intended, but also presents a number of complications. This second style ear piece has a speaker mounted on each free end of the headband. The speaker is covered in soft foam which is supported directly from the user's ear. This headphone presents many of the problems associated with the previously discussed style in that it entirely covers the user's ear canal, and therefore blocks nearly all of the ambient sound. Further, inasmuch as it is supported directly from the user's ear, it is less stable than the previous headphone and therefore is not easily worn in a physically demanding environment. Further, inasmuch as the user's ear supports the full weight of the headphone, it is less comfortable.

A third style of prior art headphone as shown in FIG. 9, attempts to solves many of the problems associated with the above two headphone styles but still presents a number of drawbacks. In this third style, the ear piece fits within the user's ear canal and therefore blocks out ambient sound. Although these ear pieces do not collect perspiration, and are relatively well anchored to the user's ears permitting them to be utilized in a physically demanding environment, inasmuch as the entire speaker is placed in the ear canal, this style headphone can become uncomfortable. Further, this style headphone cannot be cordless, as the electronics would be too heavy to include on the headband when the entire weight of the headphone is carried by the user's ear canal. Also, inasmuch as this style headphone extends into the ear canal, it cannot be used by persons that wear hearing aids within their ear canal.

Therefore, a need exists for a headphone which will carry the electronics associated with a cordless headphone, but which weight is carried by the user's head and not by the users ears, which allows ventilation to the user's ears, and which is well anchored to the user's head. Still further, the need exists for such a headphone which, when in use, allows ambient sound to enter the user's ear.

SUMMARY OF THE INVENTION

Objectives of the invention include providing an improved headphone which is cordless and self-contained.

A further objective includes providing such a headphone having an ear piece which allows ventilation and ambient sound to enter the user's ears.

Yet another objective is to provide such a headphone having an ear piece, where the weight of such ear piece and headphone is supported by the user's head, not the user's ear.

A still further objective is to provide such a headphone having an ear piece which is well anchored to the user's head when utilized in a physically demanding environment.

Yet another objective of the present invention is to provide such a headphone which may be worn by a user with a hearing aid in their ear canal, and which may also be worn comfortably by user's wearing earrings.

A further objective of the present invention is to provide such a headphone which selectively allows ambient sound to enter the user's ears, or which entirely envelops the user's ears as the environment may require.

A still further objective is to provide such a headphone which is of simple construction, which achieves the stated objectives in a simple, effective and inexpensive manner, and which solves problems and satisfies needs existing in the art.

These and other objectives and advantages of the invention are obtained by the improved headphone of the invention, the general nature of which may be stated as including a headband adapted for engaging a user's head having first and second ends; a first ear piece mounted adjacent the first end of the headband and a second ear piece mounted adjacent the second end of the headband; means to attach the ear pieces to the headband; each of said ear pieces includes a shell having a bottom wall formed with an opening, and having an acoustic cavity which communicates with said bottom wall opening; said cavity being sized to receive an upper portion of a user's ear which extends through said bottom wall opening when mounted on a user's head;

electronic communication circuitry mounted in one of the ear piece shells; and a power supply mounted in the other of the ear pieces and connected to the circuitry in the said one ear piece through the headband.

BRIEF DESCRIPTION OF THE DRAWINGS

The preferred embodiments of the invention, illustrative of the best mode in which the applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

Figure 1:
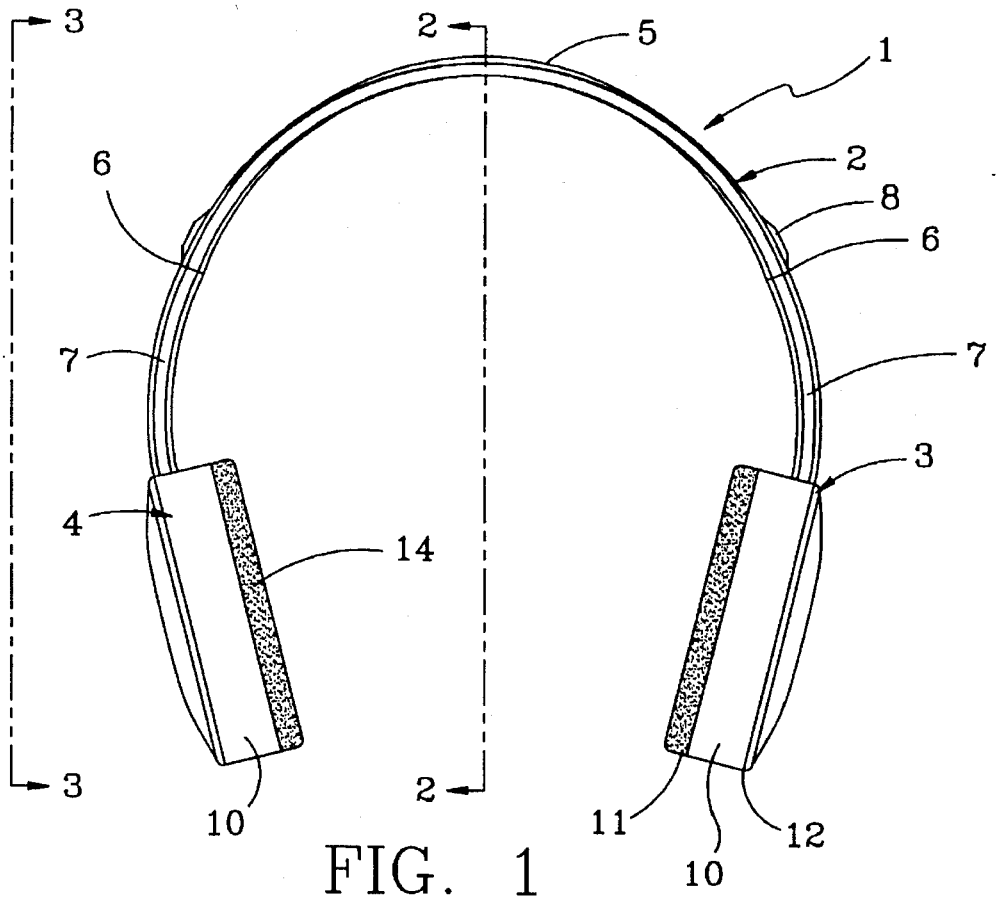
FIG. 1 is an elevational view of the headphone assembly of the present invention.
Figure 2:
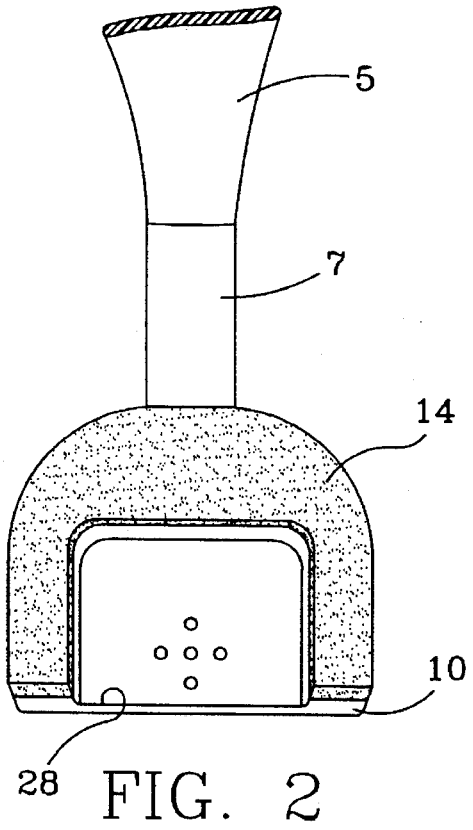
FIG. 2 is a sectional view taken substantially along line 2—2 of FIG. 1.
Figure 3:
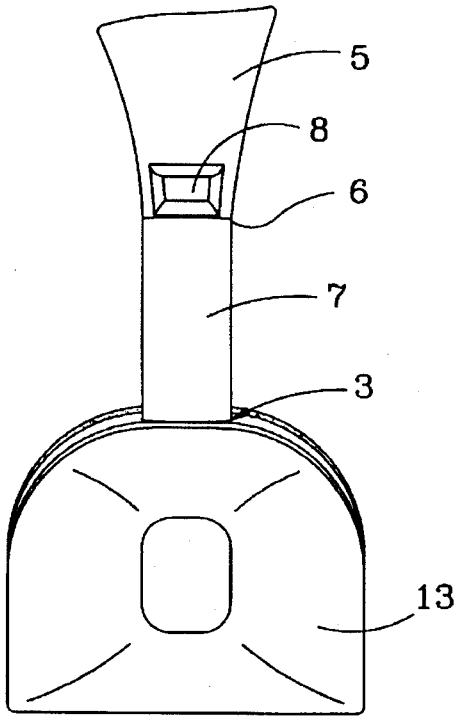
FIG. 3 is a fragmentary side elevational view looking in the direction of arrows 3—3 of FIG. 1.

A headphone assembly according to the present invention is designated generally at 1, and is shown particularly in FIGS. 1–3. Headphone assembly 1 includes a headband 2 and first and second ear pieces 3 and 4, respectively. Headband 2 preferably is formed of a resilient flexible plastic, and in the preferred embodiment, is adjustable. Specifically, headband 2 has an arcuately shaped base member 5 generally curved to the shape of a user's head, with ends 6 which are slideably engaged in slide members 7. Preferably, the sliding engagement between slide members 7 and base 5 is governed by a detent, or rachet assembly 8, both of which are well known in the art. However, any means of engagement between slides 7 and base 5 may be utilized without departing from the spirit of the present invention.

Ear pieces 3 and 4 are similar and therefore, only one will be described in complete detail. Referring specifically to FIGS. 1–5, ear piece 3 includes a substantially semi-circular shell indicated generally at 10, having a substantially inverted U-shaped inner wall or support plate 11, and an outer wall or ear plate 12. A cover plate 13 is complementarily sized to fit onto outer wall 12 of shell 10. Similarly, a resilient foam comfort pad 14 is attached to inner wall 11 for engaging the user's head.

Figure 4:
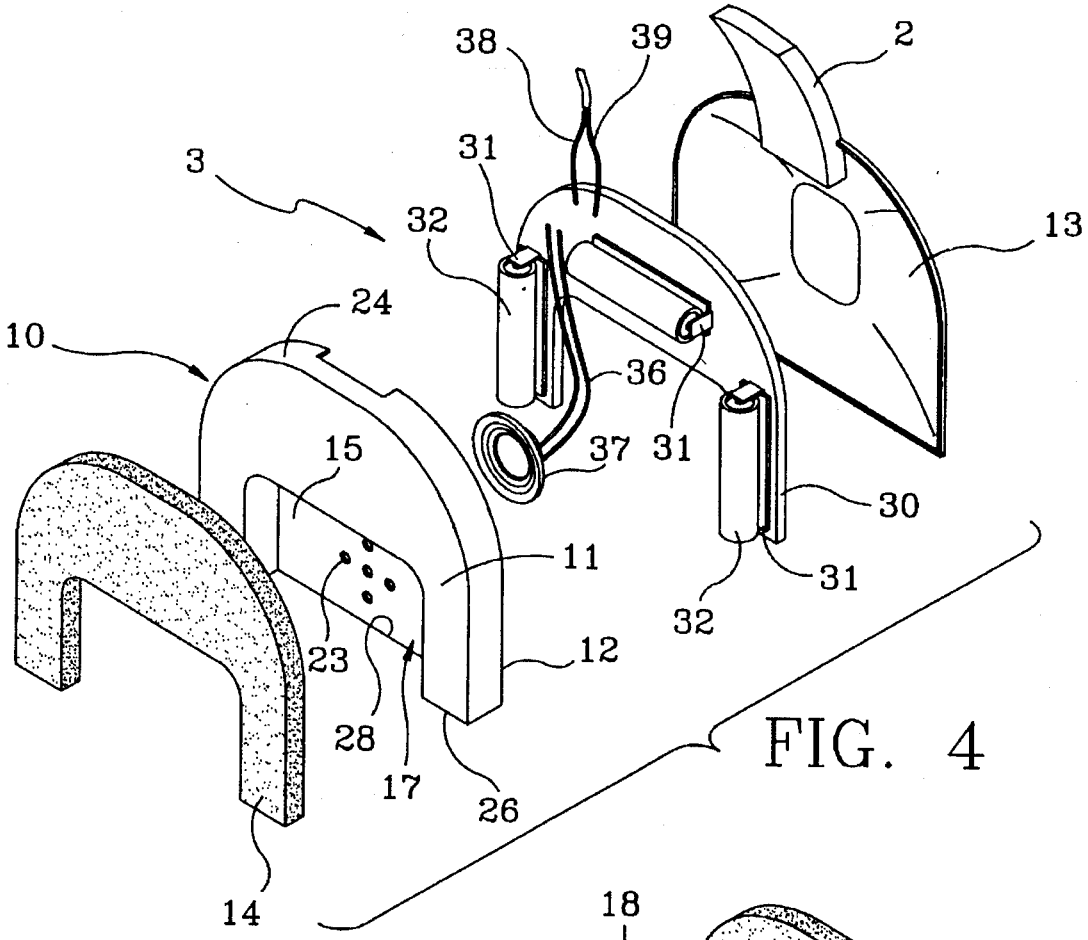
FIG. 4 is an exploded prospective view of the right ear piece of FIG. 1 with the headband broken away.
Figure 5:
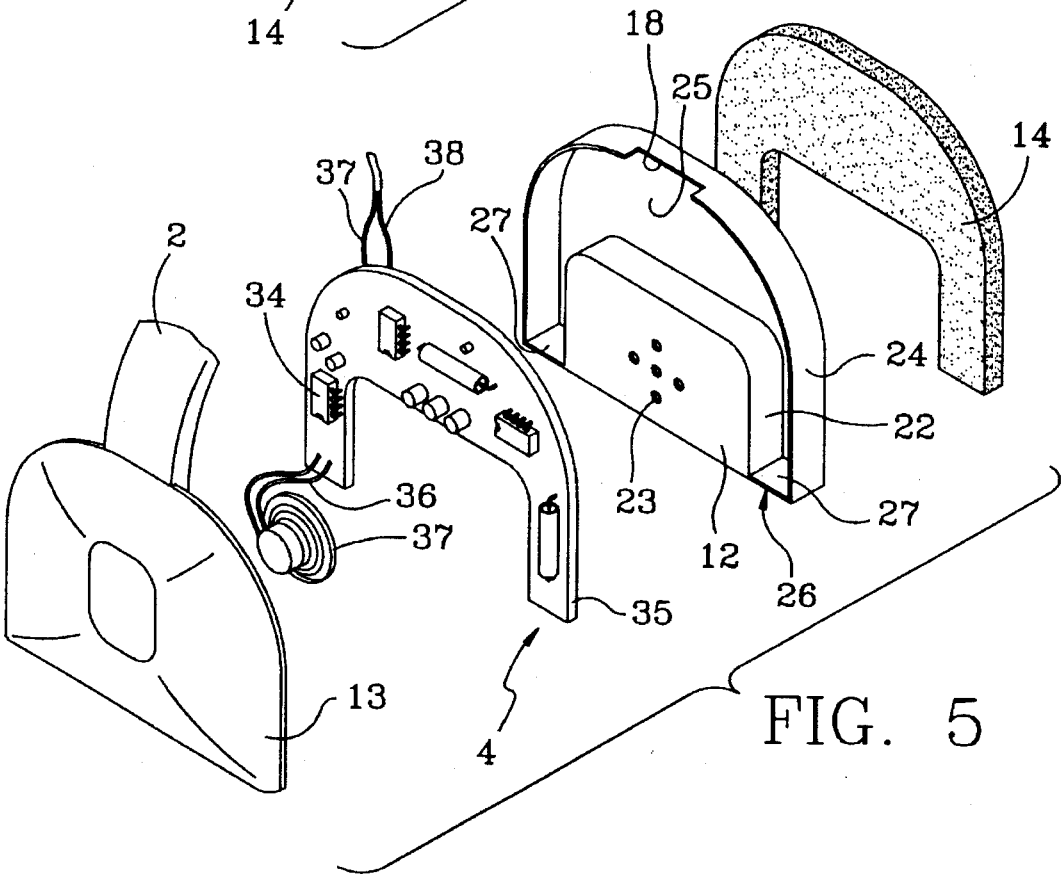
FIG. 5 is an exploded prospective view of the left ear piece of FIG. 1 with the headband broken away.
Figure 8:
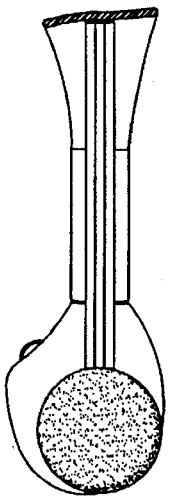
PRIOR ART FIG. 8
FIG. 8 is a sectional view of a second style of prior art headphone.

In accordance with one of the main features of the invention, and referring to FIGS. 4–5, inner wall 11 is formed with an acoustic cavity 17, the rear wall 15 of which is formed by the rear surface of outer wall 12. An inverted U-shaped cavity perimeter wall 22 having opposed parallel sidewall sections (FIG. 5), joins inner wall 11 and outer wall 12, and defines acoustic cavity 17. A plurality of holes 23 extend through outer wall 12 and cavity wall 15 and communicate with acoustic cavity 17.

A substantially inverted U-shaped semi-circular perimeter wall 24 extends outwardly from inner wall 11 toward outer wall 12 a distance substantially equal to the width of cavity perimeter wall 22. Perimeter wall 24 terminates at a bottom or end wall 26 having spaced apart wall portions 27 (FIG. 5) which join cavity perimeter wall 22 and perimeter wall 24. Wall portions 27 are spaced apart by a bottom end access opening 28 (FIGS. 2, 4 and 6), provided in a lower end of each of the ear pieces for receiving a user's ear partially thereon. As such, inner wall 11, outer perimeter wall 24, inner cavity perimeter wall 22, wall portions 27 and access opening 28 form a substantially inverted U-shaped cavity or chamber 25 (FIG. 5) in shell 10 of each of the ear pieces. Further, perimeter wall 24 includes a notch 18 which is complementarily sized to the cross-section of headband 2 so as to receive headband 2 therein, when base 5 is assembled with cover plate 13.

The right ear piece 3 (FIG. 4) includes a substantially inverted U-shaped power board 30 which is complementarily sized to fit within U-shaped chamber 25 of shell 10. Power board 30 is shown in reverse in FIG. 4 from the direction it will assume when mounted in ear piece 3 for clarity. Three battery clips 31 are mounted on power board 30 for releasably holding standard 1.5 volt batteries 32 which provide the power source for the electronic circuitry of the headphones.

Similarly, left ear piece 4 (FIG. 5) includes an inverted U-shaped circuit board 35, which board is complementarily sized to fit within U-shaped chamber 25. Circuit board 35 is fitted with one of a variety of well known electrical circuits which could be a printed circuit or hard wired, for sending and receiving signals used in prior art headphones. Therefore, no particular circuitry is shown in complete detail. However, in the preferred embodiment, circuit board 35 is fitted with the electronic elements 34 readily known in the art to form a cordless radio receiver for receiving either public radio transmissions for entertainment purposes, or for receiving private transmissions in the form of radio waves, or infrared signals, such as when used in an industrial or commercial setting. In the industrial or manufacturing setting, these radio waves or signals are instructions to the user when in the workplace, such that the user may appropriately act on such signals or instructions.

When power board 30 or circuit board 35 is mounted within a corresponding chamber 25, the rear surface thereof contacts the inner surface of inner wall 11. Speaker leads 36 also extends off of each board 30 and 35, and connects to a respective speaker 37. In assembly, a power feed wire 38 extends through headband 2 to supply power from power board 30 to circuit board 35. Similarly, a speaker lead wire 39 extends from circuit board 35 to power board 30 to connect to speaker leads 36.

When boards 30 and 35 are mounted in respective chambers 25, speakers 37 are mounted adjacent the inner surfaces of outer wall 12, and behind acoustic holes 23 such that sound emanating from speakers 37 is transferred into acoustic cavities 17, through holes 23. Once boards 30 and 35 are mounted in respective chambers 25, and speakers 37 are mounted adjacent holes 23, a cover plate 13 is snap mounted onto each shell 10 thereby enclosing speakers 37 and the corresponding board 30 or 35. Preferably, cover 13 which is mounted over power board 30 is removably mounted thereon, so as to allow access to battery clips 31 for replacement of batteries 32. However, cover 13 could be permanently mounted onto shell 10, and have an access door (not shown) to allow for replacement of the batteries, without departing from the spirit of the present invention.

Lastly, comfort pads 14 are mounted on each inner wall 11, preferably by an adhesive, or by any convenient attachment means, in order to provide increased comfort to the wearer.

As is apparent to one of ordinary skill in the art, cover plate 13 may take a variety of shapes without departing from the spirit of the invention. However, in the preferred embodiment, plate 13 is substantially dome shaped, such that sufficient space is provided between the inner surface of cover plate 13 and wall 12, so that speaker element 37 may be interposed therebetween.

Figure 6:
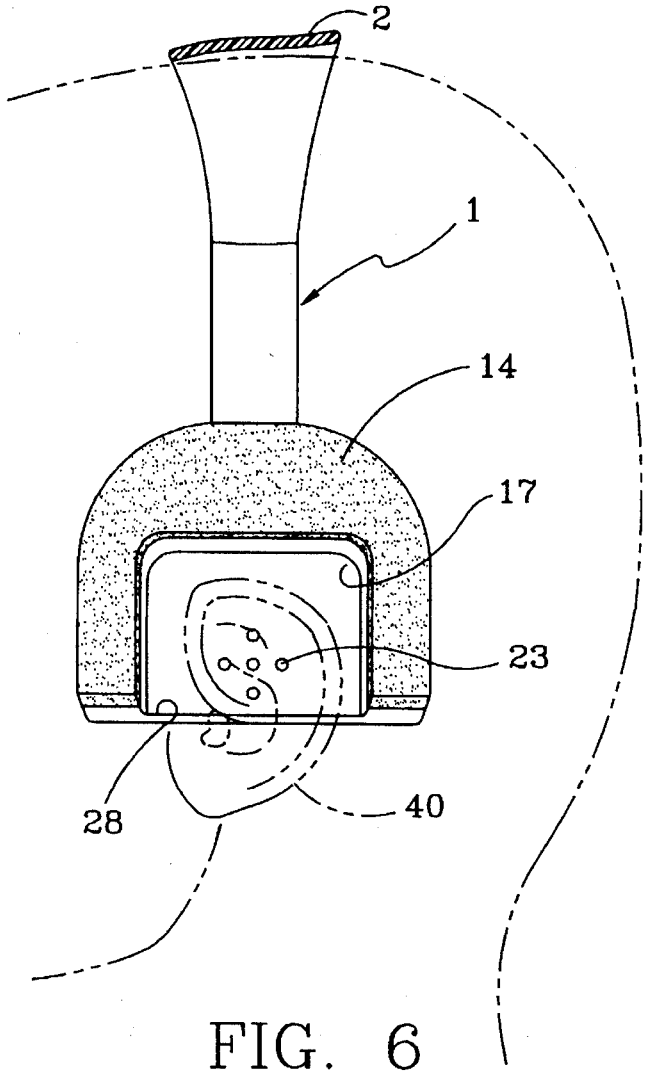
FIG. 6 is a sectional view similar to FIG. 2, of the headphone shown in cooperation with a user's head which is shown in dot-dash lines.
Figure 7:
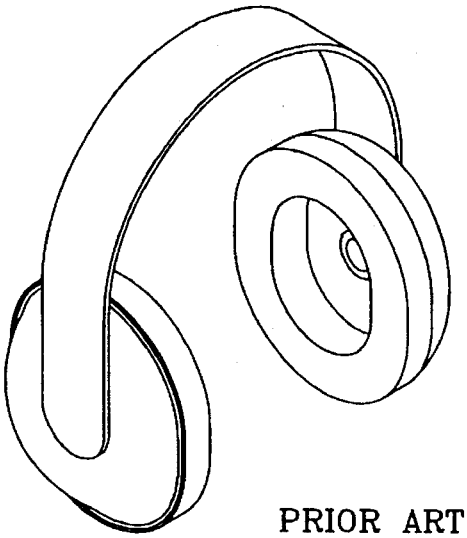
PRIOR ART FIG. 7
FIG. 7 is a perspective view of one style of prior art headphone.
Figure 9:
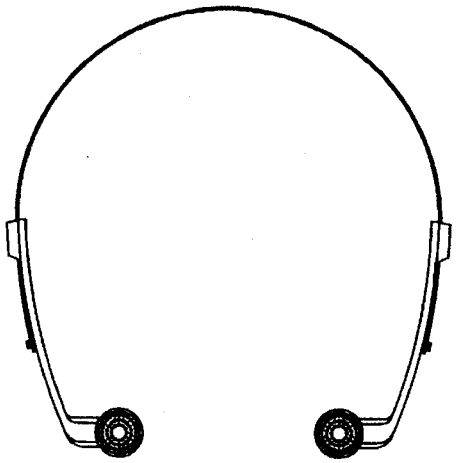
PRIOR ART FIG. 9
FIG. 9 is a elevational view of a third style of prior art headphone.

Turning to the operation of headphone assembly 1 and referring specifically to FIG. 6, there is shown headphone assembly 1 worn by a user. Specifically, headband 2 extends over the user's head, with the user's ear extending partially into acoustic cavity 17 through bottom end opening 28. When the headphone is worn by the user, approximately the upper one-half of the user's ear 40 extends into acoustic cavity 17, and the remainder of the user's ear extends out of access opening 28 in endwall 26. In this manner a portion of the entrance to the user's ear canal partially extends out of acoustic cavity 17 to allow the user to hear ambient sounds.

Further, inasmuch as the user's ear canal remains unimpinged by speaker elements, a user with a hearing aid may still utilize this headphone. Also, inasmuch as the user's earlobes extend outwardly from the ear piece, a user with earrings can also use the headphone. Likewise, inverted U-shaped foam pad 14 will press lightly against the user's head and cavity perimeter walls 22 may engage the user's ears to retain the headphone on the user's head and in position with respect to the user's ears. However, the ear itself does not support the weight of the headphone as it is directly supported on the user's head in the area circum ambient to the user's ear at foam pad 14. Thus the headphone remains stable on the user's ears while still remaining comfortable to the user's head.

Turning then to the second embodiment of the present invention, the headphone assembly is designated generally at 50, and is shown particularly in FIGS. 10–13. Headphone assembly 50 is similar to the first embodiment of the present invention and includes headband 2, and a pair of ear pieces 3A and 4A which differ in some respects from ear pieces 3 and 4 of the first embodiment. Each ear piece 3A and 4A includes a semi-circular shell indicated generally at 51, which is identical to semi-circular shell 10, except that it includes a pair of pivot recesses 52 each of which has a pivot pin 53 extending outwardly therefrom. A cover plate 54 is complementary sized to fit shell 51. Cover plate 54 is similar to cover plate 13 except that it is planar rather than arcuate.

Figure 10:
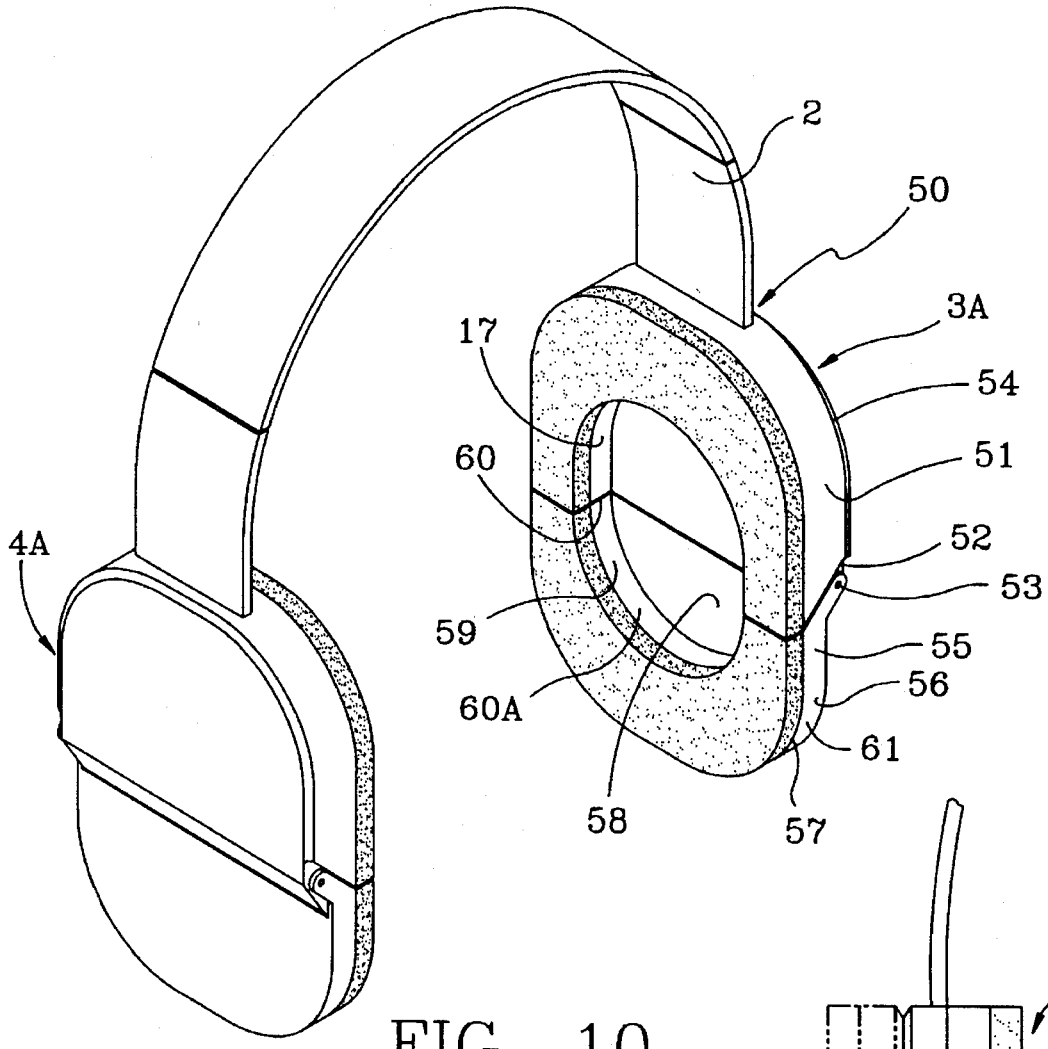
FIG. 10 is a perspective view of a second embodiment of the present invention.
Figure 11:
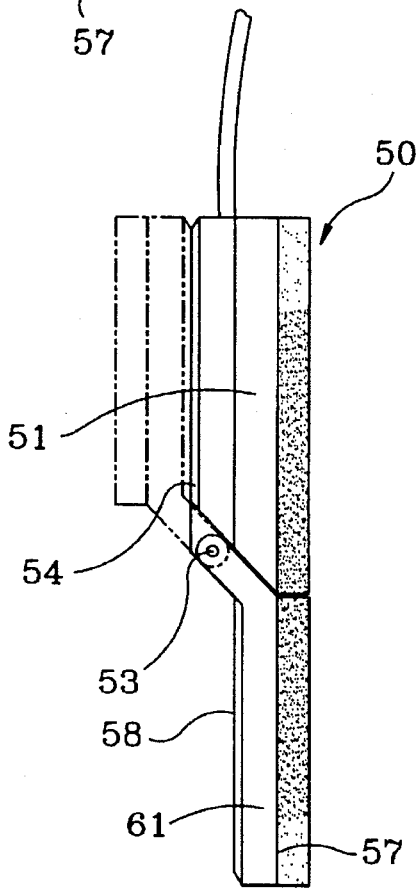
FIG. 11 is a fragmentary elevational view of the headphone assembly of the present invention with the lower portion shown in solid lines in the closed position, and in dot-dash lines in the open position.

In accordance with one of the main features of the second embodiment of the present invention, a U-shaped lower ear piece 55 is pivotally mounted to each shell 51 (FIGS. 10 and 11). Each lower ear piece 55 includes a U-shaped shell 56 having a U-shaped inner wall 57, an outer wall 58 and a U-shaped cavity perimeter wall 60A (FIG. 10) which joins inner wall 57 and outer wall 58 and defines an acoustic cavity 59. Acoustic cavity 59 has an open end 60 for selectively communicating with acoustic cavity 17 of shell 10. Walls 57 and 58 form an acoustic cavity 59.

A U-shaped perimeter wall 61 (FIG. 13) extends around the outside of lower ear piece 55 and terminates at a top or end wall 62 having spaced apart wall portions 63 which join cavity perimeter wall 60A and perimeter wall 61.

In further accordance with one of the main features of the present invention, a pair of parallel and spaced apart pivot arms 64 extend upwardly from both ends of lower ear piece 55 adjacent each end wall 63. Each pivot arm 64 includes a through hole 65 for pivotally receiving a respective pivot pin 53. A resilient foam comfort pad 66, similar to comfort pad 14, is attached to inner wall 57 for engaging the user's head. All the necessary electronics described with respect to headphone assembly 1 are retained within semi-circular shell 10 of ear pieces 3 and 4.

Figure 12:
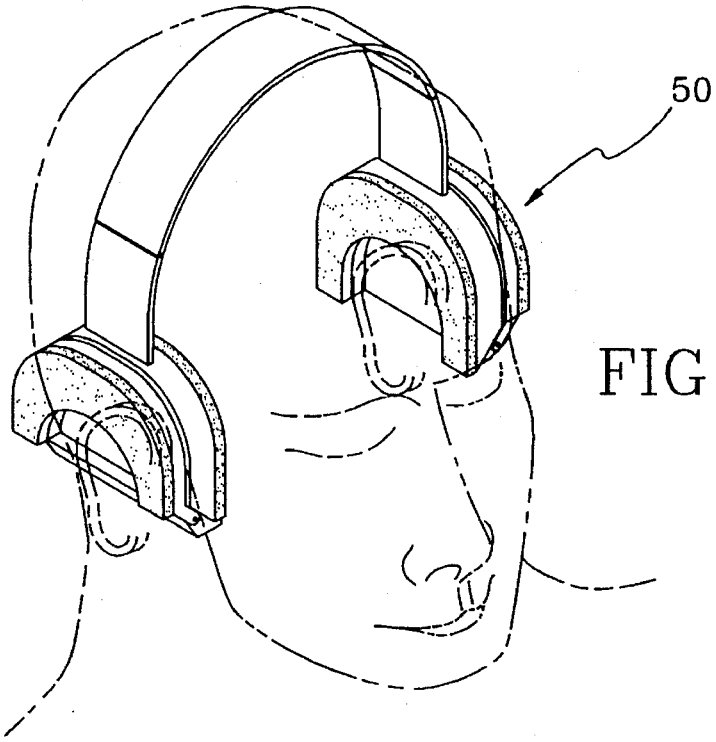
FIG. 12 is a perspective view of the headphone assembly shown in FIG. 10; shown with the lower portion in the open position, and shown in association with a user's head.
Figure 13:
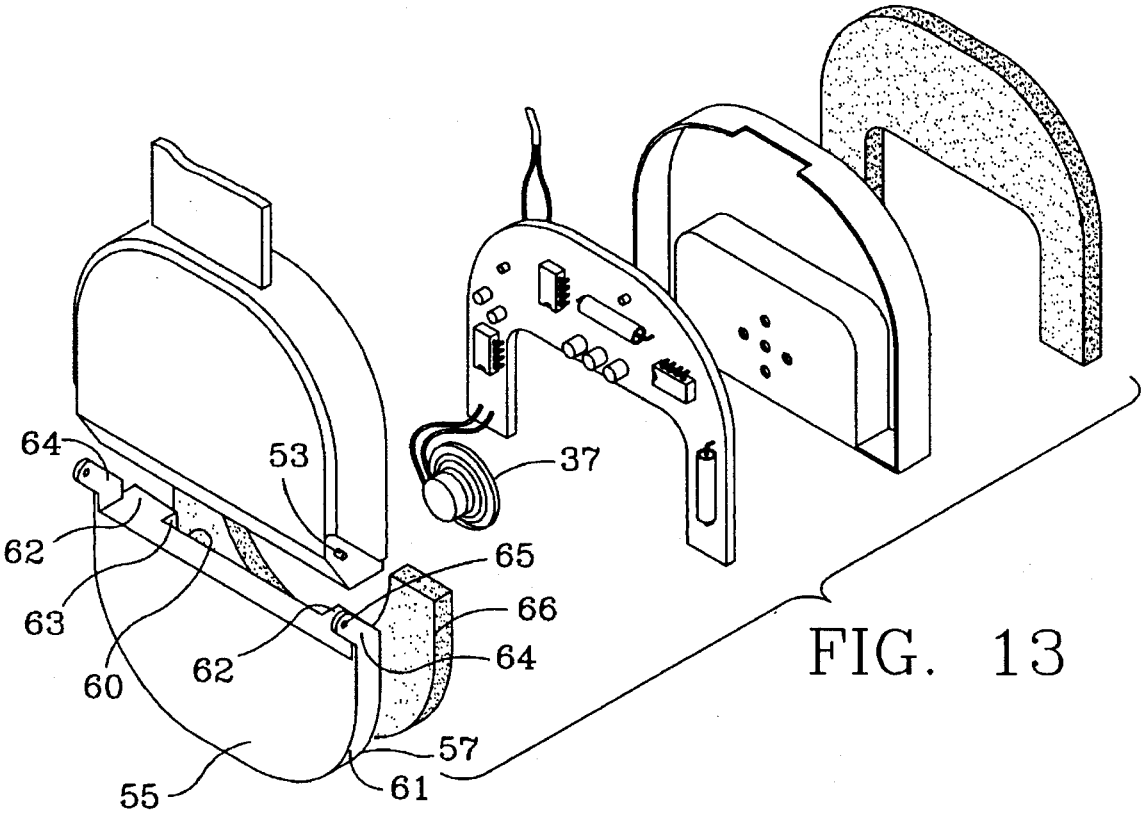
FIG. 13 is an exploded perspective view of the left ear piece of FIG. 10 with the headband broken away.

In operation, lower ear piece 55 is movable between the closed position shown in solid lines in FIG. 11, and the open position shown in dot-dash lines and as shown in FIG. 12 in solid lines. The rotation of pivot arms 64 about pivot pin 53 provides the movement between the open and closed positions. When lower ear piece 55 is in the closed position, end wall 62 contacts end wall 26 of shell 10. Similarly, comfort pad 66 extends around the lower portion of the user's ear when lower ear piece 55 is in the closed position such that comfort pads 66 and 14 collectively engage the user's head around each of the user's ears.

Alternatively, when lower ear piece 55 is pivoted about pivot pin 53 to the open position shown in FIG. 12, outer wall 58 contacts cover plate 54 of shell 51. Lower ear piece 55 is retained in the raised position shown in FIG. 12 via the frictional engagement between pivot arm 64 and pivot recess 52. Alternatively, a detent engagement (not shown), may be utilized without departing from the spirit of the present invention.

The user may utilize headphone assembly 50 in the open position shown in FIG. 12 when the user wishes to hear ambient noise such as when the user is jogging, or engaging in activities where ambient noise will warn the user of danger. Alternatively, the user may wish to use headphone assembly 50 with lower ear piece 55 in the closed position as shown in FIG. 10 when it is not necessary to hear ambient noise; for example, when the user is listening to music at home.

While lower ear piece 55 does not include electronics as discussed hereinabove, it effectively operates to create a sealed acoustic cavity about the user's ear to greatly increase the sound quality emanating from speakers 37.

Figure 14:
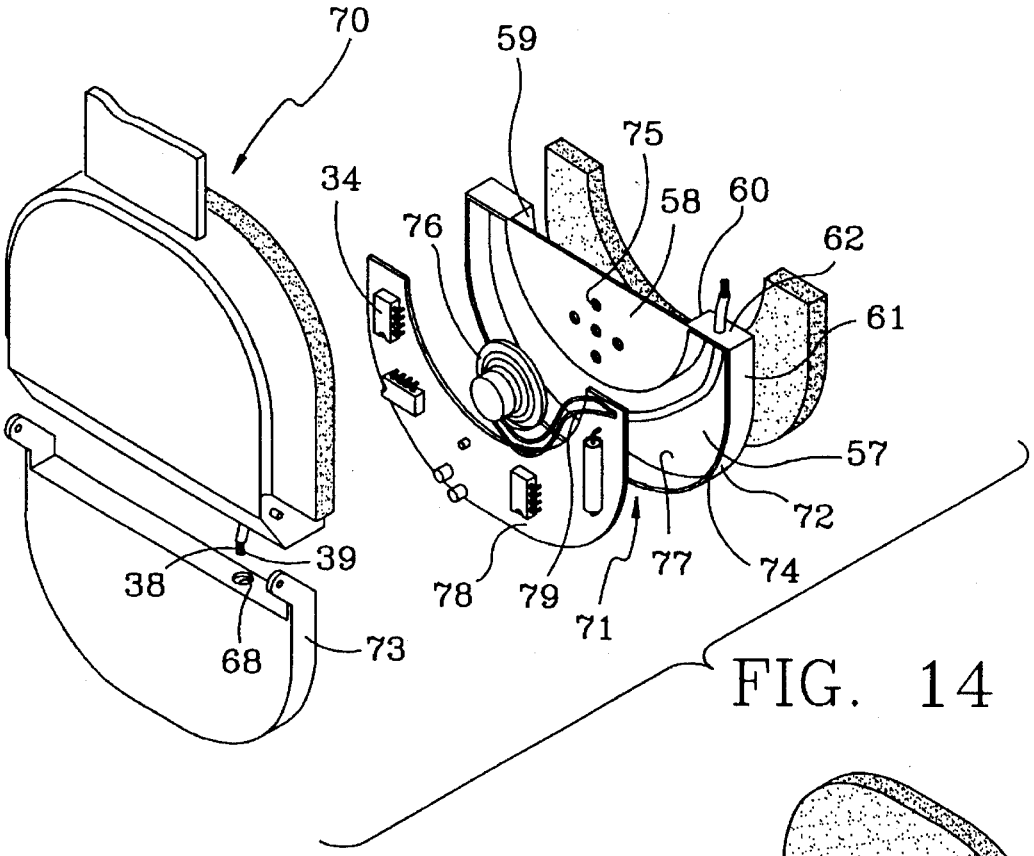
FIG. 14 is a fragmentary exploded perspective view of a third embodiment of the present invention.

A third embodiment of the present invention is shown in FIG. 14, and is indicated generally at 70. Headphone assembly 70 includes a shell 51 identical to the shell of the second embodiment of the invention. However, shell 51 does not house the electronics portion of the headphone assembly.

Rather, lower ear piece 71, similar to lower ear piece 55, retains the electronics. Lower ear piece 71 differs from lower ear piece 55 only in that it includes an ear plate 72 and a cover plate 73 complementary sized to fit on an outer wall 74 of ear plate 72. Ear plate 72 is identical to shell 56 in that it includes an inner wall 57, an outer wall 58, an acoustic cavity 59, an acoustic cavity perimeter wall 60, and a U-shaped perimeter wall 61. Moreover, acoustic cavity perimeter wall 60 and U-shaped perimeter wall 61 are joined by an end wall 62. A plurality of holes 75 extend through outer wall 58 adjacent a speaker 76 such that sound emanating from speaker 76 will travel through hole 75 and into cavity 59. As such, inner wall 57, acoustic cavity perimeter wall 60, U-shaped perimeter wall 61 and end wall 62 form a substantially U-shaped cavity or chamber 77.

One ear piece includes a substantially U-shaped power board (not shown), and the other ear piece includes a U-shaped circuit board 78, each of which is complementary sized to fit within a respective U-shaped chamber 77. Circuit board 78 is fitted with one of a variety of well known electrical elements 34 which could be a printed circuit for sending and receiving signals such as those used in prior art headphones. Therefore, no particular circuitry is shown in complete detail. However, in the preferred embodiment, circuit board 78 is fitted with the electronic elements 34 readily known in the art to form a cordless radio receiver for receiving either public radio transmissions for entertainment purposes, or for receiving private transmissions in the form of radio waves, or infrared signals, such as when used in an industrial or commercial setting. In the industrial or manufacturing setting, these radio waves or signals are instructions to the user when in the workplace, such that the user may appropriately act on such signals or instructions.

When circuit board 78 and the power board are mounted within respective chambers 77, the rear surface thereof contacts the inner surface of inner wall 57. Speaker leads 79 also extend off of each board and connect to a respective speaker 76. Further, cover plate 73 and ear plate 72 each include a small through hole 68 for receiving the power lead wire 38 and speaker lead wire 39 described in the first embodiment of the invention.

The remaining portions of the third embodiment of headphone assembly 70 are identical to headphone assembly 50.

When lower ear piece 71 is in the closed position such that ear pieces 3A and 4A entirely envelop the user's ears, the user hears sounds emanating from speakers 76. However, when lower ear pieces 71 are moved to the raised position, the user hears no sounds emanating from speakers 76. The user is thus not required to remove headphone assembly 70, or to turn off assembly 70 if, for example, a person should enter the room and engage in a short conversation with the user. The user may merely may flip up the lower ear pieces 71 and engage in the short conversation, and pivot lower ear pieces 71 back to the closed position and continue listening to sound emanating from speakers 76.

Figure 15:
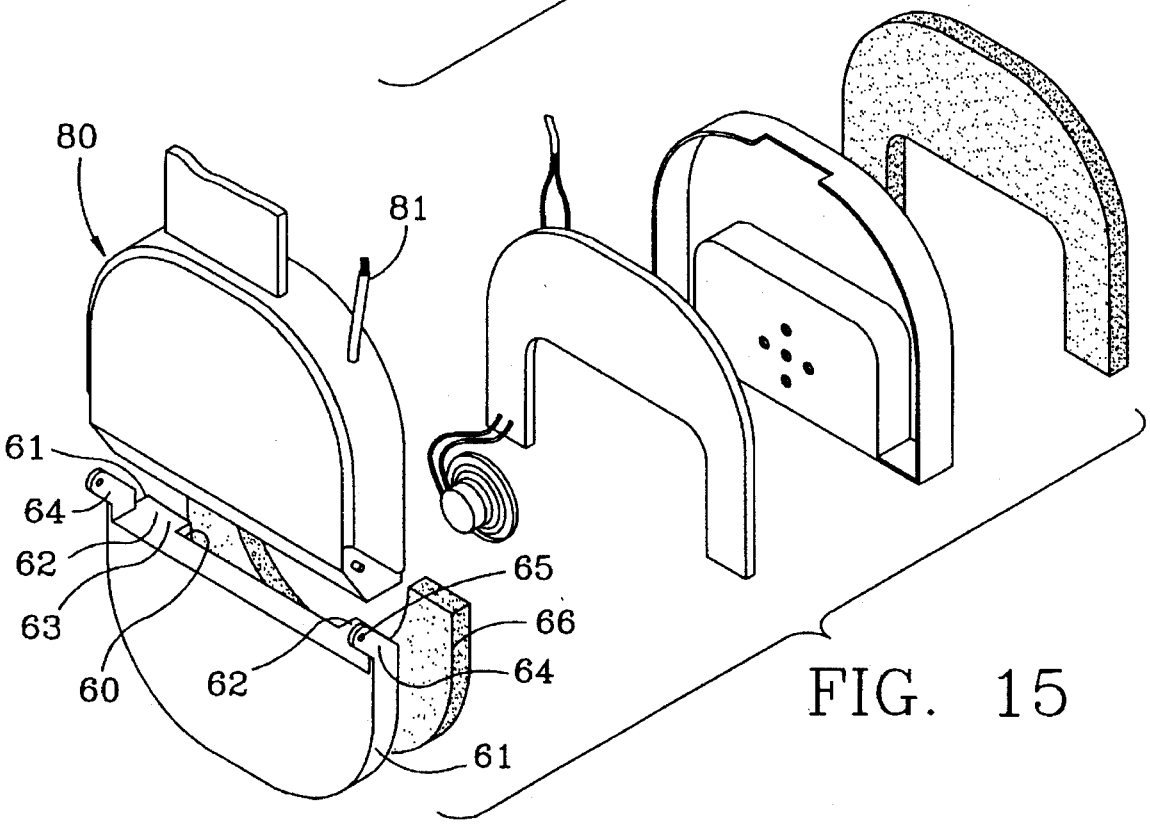
FIG. 15 is a fragmentary exploded perspective view of a fourth embodiment of the present invention.

A fourth embodiment of the invention is shown specifically in FIG. 15, and is indicated generally at 80. The fourth embodiment of the invention is identical to the second embodiment of the invention except that the fourth embodiment of the invention does not include the electronics described with respect to headphone assembly 1 of the first embodiment, and headphone assembly 50 of the second embodiment of the invention and therefore will not be described in great detail. Only a speaker 37 is provided in each shell 56, and a signal receiving wire 81 extends outwardly from one of the shells for connection to a standard radio receiver (not shown). Again, headphone assembly 80 permits the user to hear both ambient sound, and music emanation from the speakers housed therein when lower ear piece 55 is in the open position, and will block out ambient sound when lower ear piece 55 is pivoted to the closed position substantially as described above with respect to headphone assembly 50.

Alternatively, speakers 37 may be housed on each lower ear piece 55 as described in the third embodiment of the invention, without departing from the spirit of the present invention.

Accordingly, the improved headphone assembly is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved headphone assembly is constructed and used, the characteristics of the construction, and the advantageous, new and useful results obtained; the new and useful structures, devices, elements, arrangements, parts and combinations, are set forth in the appended claims.

I claim:

1. A headphone comprising:

a headband adapted to extend along a portion of a user's head;

a first upper ear piece mounted on the headband;

said first upper ear piece having a shell formed with a partially enclosed acoustic cavity having an open lower end adapted to accept and partially enclose only an upper portion of a user's ear, with a lower portion of the user's ear extending through said open end;

a first lower ear piece formed with a shell having a partially enclosed acoustic cavity having an open upper end adapted to accept and partially enclose only a lower portion of a user's ear;

attachment means for movably attaching the first lower ear piece to the first upper ear piece for movement between a closed position and an open position; and a speaker element mounted adjacent the acoustic cavity of one of the first upper ear piece and the first lower ear piece.

2. A headphone assembly defined in claim 1 in which the acoustic cavity of said first upper ear piece has an inverted U-shape and is formed by spaced parallel sidewalls and an end wall substantially perpendicular to said sidewalls.

3. A headphone assembly as defined in claim 2 in which the acoustic cavity formed in said first lower ear piece has a U-shape formed by a pair of spaced parallel sidewalls and an end wall substantially perpendicular to said sidewalls; and in which said open end of the cavity is formed in said end wall.

4. A headphone assembly as defined in claim 3 in which the endwall of the first upper ear piece, and the end wall of the first lower ear piece are contiguous when said first lower ear piece is in the closed position.

5. A headphone assembly as defined in claim 4 in which the movable attachment means includes a pair of pivot pins extending outwardly from one of the first upper ear piece and first lower ear piece, and a pair of pivot arms extending outwardly from the other one of said first upper ear piece and said first lower ear piece; and in which each of said pivot arms includes a through hole for accepting a corresponding pivot pin to provide rotational movement between said first upper ear piece and said first lower ear piece.

6. A headphone assembly as defined in claim 5 in which the acoustic cavity of one of the first upper ear piece and the first lower ear piece is formed in a shell; in Which a speaker element is mounted adjacent the acoustic cavity of one of the first upper ear piece and first lower ear piece, and in which a cover plate extends over the speaker element such that the speaker element is interposed between the cover plate and the shell.

7. A headphone assembly as defined in claim 6 further comprising a cable extending outwardly from the upper ear piece adapted to electronically communicate with an electronic signal generating device.

8. A headphone assembly defined in claim 1 in which the speaker is mounted adjacent the acoustic cavity of the first upper ear piece.

9. A headphone assembly as defined in claim 1 in which the speaker element is mounted adjacent the acoustic cavity of the first lower ear piece.

10. A headphone assembly as defined in claim 1 in which a chamber is formed in one of the shells of the first upper ear piece and the first lower ear piece; and in which the chamber extends generally about the acoustic cavity of one of the first upper ear piece and the first lower ear piece.

11. A headphone assembly as defined in claim 10 in which the chamber has an inverted U-shape and is formed in the shell of the first upper ear piece and extends generally about the acoustic cavity of the first upper ear piece.

12. A headphone assembly as defined in claim 11 in which an inverted U-shaped support plate is mounted in the inverted U-shaped chamber; and in which communication circuitry is mounted on said support plate.

13. A headphone assembly as defined in claim 12 in which the inverted U-shaped chamber and acoustic cavity are located on opposite sides of the shell.

14. A headphone assembly as defined in claim 13 in which a second ear piece substantially similar to the first ear piece is mounted on an opposite end of the headband from said first ear piece.

15. A headphone assembly as defined in claim 1 in which a U-shaped chamber is formed in the lower ear piece and extends generally about the acoustic cavity of the first lower ear piece.

16. A headphone assembly as defined in claim 15 in which a U-shaped support plate is mounted in the U-shaped chamber; and in which communication circuitry is mounted on said support plate.

17. A headphone assembly as defined in claim 16 in which a second ear piece substantially similar to the first ear piece is mounted on an opposite end of the headband from said first ear piece.

18. A headphone assembly as defined in claim 17 further comprising latch means for releasably securing the lower ear piece in the open position.

19. A headphone assembly as defined in claim 1 further including means for attaching the upper ear piece to the headband.

20. A headphone assembly comprising:

a headband having first and second ends for engaging a wearer's head;

a first ear piece mounted adjacent the first end of the headband and a second ear piece mounted adjacent the second end of the headband;

means to attach the ear pieces to the headband; each of said ear pieces including an upper shell having a bottom wall formed with an opening, and having an acoustic cavity which communicates with said bottom wall opening; said cavity being sized to receive an upper portion of the user's ear which extends through said bottom wall opening when mounted on a user's head;

a first lower ear piece formed with a shell having a partially enclosed acoustic cavity having an upper open end adapted to accept and partially enclose only a lower portion of the user's ear, such that the upper portion of the user's ear extends through the open upper end, with the upper portion of the user's ear already enclosed by the upper ear piece;

movable attachment means for attaching the first lower ear piece to the first upper ear piece; and for permitting movement of said first lower ear piece between a closed position and an open position; one of said first upper ear piece and first lower ear pieces being formed with a chamber extending at least partially around the respective acoustic cavity; and electronic communication circuitry mounted in said chamber, and a power feed wire extending through the headband to supply power from a power board to the circuitry.

* * * * *